United States Patent [19]

Butterworth

[11] 4,032,735

[45] June 28, 1977

[54] CONTACT UNIT

[75] Inventor: Edmund Morton Butterworth, Bedford, England

[73] Assignee: Cutler-Hammer, Inc., Milwaukee, Wis.

[22] Filed: Aug. 7, 1975

[21] Appl. No.: 602,922

[30] Foreign Application Priority Data

Aug. 29, 1974 United Kingdom ..... 37776/74

[52] U.S. Cl. ..... 200/68; 200/243; 335/132

[51] Int. Cl.[2] ..... H01H 67/02

[58] Field of Search ..... 200/68, 243, 280; 335/132, 197

[56] References Cited

UNITED STATES PATENTS

| | | | |
|---|---|---|---|
| 2,868,914 | 1/1959 | Gleason | 200/68 |
| 3,053,337 | 9/1962 | Prohaska et al. | 200/68 |
| 3,855,558 | 12/1974 | Hayward | 200/243 |

*Primary Examiner*—Herman J. Hohauser
*Attorney, Agent, or Firm*—Hugh R. Rather; William A. Autio; Michael E. Taken

[57] ABSTRACT

An electrical contact unit, for example an add-on block for detachable attachment to an electromagnetic relay itself incorporating contact sets driven by the electromagnet, comprising at least one contact set normally biased closed and means for retaining the contact set in the closed condition against an applied actuating force until the actuating force exceeds a threshold value, whereupon the contact set snaps open. The retaining means may comprise a ball bearing urged outwardly from a channel formed in a linearly-movable actuating member for the contact set and a shoulder behind which the ball bearing engages when the contact set is in the closed condition.

6 Claims, 5 Drawing Figures

CONTACT UNIT

BACKGROUND OF THE INVENTION

This invention relates to an electrical contact unit comprising at least one contact set for actuation by an electromagnet.

The invention has particular reference to an add-on block (having several contact sets arranged side-by-side) for detachable attachment to an electromagnetic relay itself including several contact sets also arranged side-by-side. The relay is arranged to apply an actuating force to all contact sets (its own and those of the add-on block) upon energization of an electromagnet included in the relay, the armature then moving against return springs also provided in the relay.

With normally closed contact sets of the prior art, energization of the electromagnet, with consequent attraction of the armature against the bias of the return springs, provides opening of each contact set. However, as the armature moves against the bias of the return springs, the respective biasing springs of the contact sets keep the contact sets closed for a substantial proportion of the armature movement. Thus, particularly if the electromagnet is energized slowly, the pressure between the mating contacts of each closed contact set decreases gradually until a balance is reached when there is no contact pressure left.

SUMMARY OF THE INVENTION

This invention provides an electrical contact unit comprising at least one contact set biased normally closed by a respective spring and means for retaining the contact set closed against an actuating force until said actuating force exceeds a threshold value, whereby the contact set snaps open upon said actuating force exceeding said threshold value.

With the contact unit according to the invention, the retaining means prevents any tendency of the contact set to open until the attractive forces of the electromagent have built up to the threshold level, whereupon the armature snaps over and the contact sets snap open. This provides a clean snap from normally closed to normally open, which is found to be much preferred to the prior art mode of operation. The invention therefore avoids, in a simple manner, the provision of a stronger, and therefore and more expensive, electromagnet is given circumstances to achieve clean opening.

The retaining means may comprise a ball bearing urged outwardly from a transverse channel or bore in a linearly-moving actuating member, and a stationary shoulder behind which the ball bearing engages when the contact set is closed. The contact unit may comprise the relay, and in that case any add-on block to be attached to the relay would not need the retaining means.

Some of the contact sets in the add-on block can be normally closed and the others normally open, likewise some of the contact sets in the relay can be normally closed and the other normally open.

BRIEF DESCRIPTION OF THE DRAWINGS

Embodiments of the invention will now be described, by way of example only, with reference to the accompany drawings, in which:

Referring to FIGS. 1 to 4 of the drawings, there is shown an add-on block for detachable attachment, for example in a snap-engageable manner, to an electromagnetic relay (not shown). The relay will comprise four contact sets side-by-side for simultaneous actuation by an actuating member coupled to the armature of an electrogmagnet in the relay. Energization of the electromagnet attracts the armature against the bias of return springs also provided in the relay and in consequence actuates the contact sets. The contact sets in the relay may be normally closed or all normally open or there may be some normally closed and the rest normally open.

The add-on block which is shown comprises four contact sets 10, 11, 12, 13 side-by-side in a plastics housing 14. The contact sets may all be normally closed, but in the example shown the contact set 12 is normally open and is shown in detail in the sectional FIG. 3. FIG. 2 shows details of normally closed contact set 11. Thus, the normally closed contact set 11 comprises two fixed contacts **11*a*, 11*a* connected to two external screw terminals 11*b*, 11*b* and two moving contacts, 11*c*, 11*c* carried on a bridge 11*d*. The bridge 11*d* extends transversely through a slot 11*e* formed in a linearly movable actuating member 15 provided in the add-on block and common to all four contact sets 10, 11, 12, 13. A biasing spring 11*f* is provided in the contact set 11 to bias the bridge 11*d* in the direction to close the moving contacts 11*c*, 11*c* across the fixed contacts 11*a*, 11*a*. Similarly, the normally open contact set 12 comprises two fixed contacts 12*a*, 12*a* connected to two external screw terminals 12*b*, 12*b* and two moving contacts 12*c*, 12*c* carried on bridge 12*d*. The bridge 12*d* extends through a slot 12*e* in the actuating member 15 and a biasing spring 12*f* is provided to bias the moving contacts 12*c*, 12*c* normally open relative to the fixed contacts 12*a*, 12*a*.**

Figure 1:
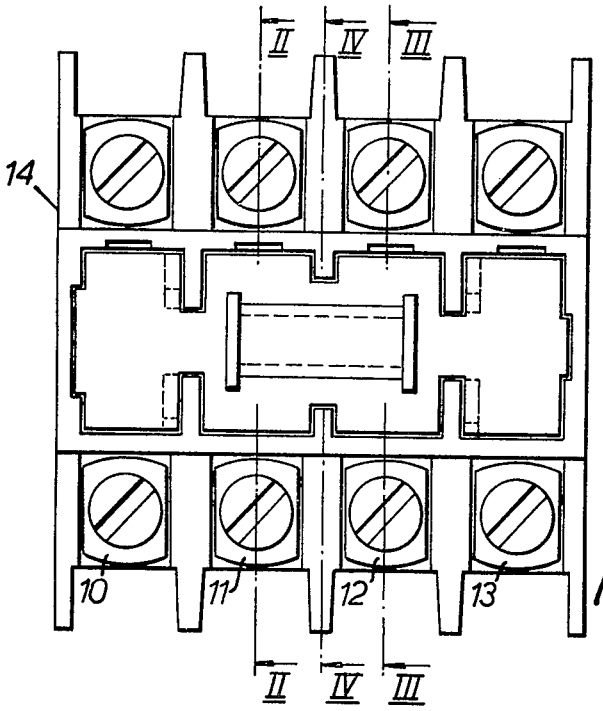
FIG. 1 is an elevation of the top of a contact unit, comprising an add-on block.
Figure 2:
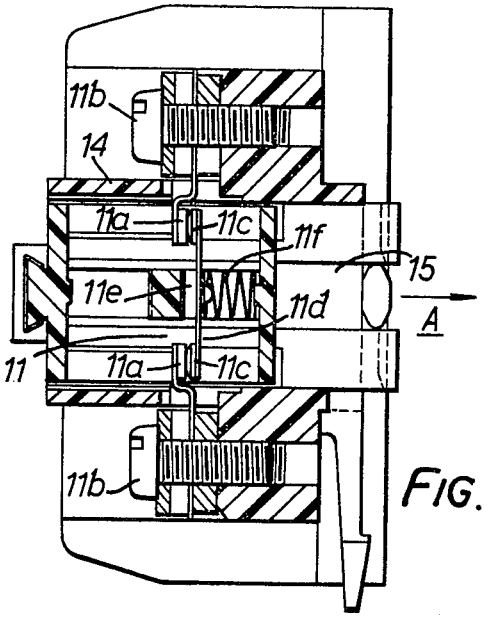
FIG. 2 is a section through the add-on block along the line II—II of FIG. 1.
Figure 3:
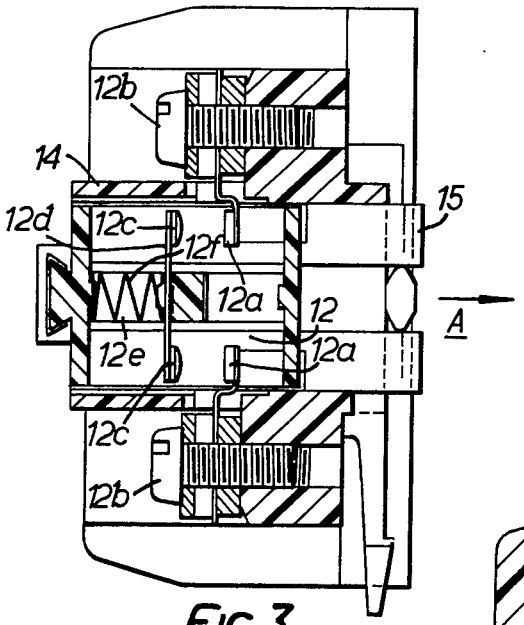
FIG. 3 is a section through the add-on block along the line III—III of FIG. 1.

The actuating member 15 of the add-on block is arranged to couple with the actuating member of the relay, when the add-on block is attached to the relay. Then energization of the electromagnet in the relay causes linear movement of the relay actuating member, to actuate the contact sets of the relay, and also linear movement of the add-on block actuating member 15 is actuate the contact sets 10, 11, 12, 13. Such linear movement is in the direction of the arrow A in FIGS. 2–4.

The add-on block further includes retaining means (see FIG. 4) for retaining the normally closed contact sets closed against an actuating force until that actuating force exceeds a threshold value, whereby those contact sets snap open cleanly upon the actuating force exceeding the threshold. Specifically, a ball bearing 16 is urged outwardly by a helical spring 17 from a transverse bore 18 formed on the actuating member 15, and a shoulder 19 is formed on the housing 14 of the add-on block for the ball bearing to engage behind when the actuating member is in its normal position. An enlargement **15*a* is formed at the actuating member 15 opposite the open end of bore 18, to run on a smooth surface of the housing 14** and guide the actuating member in its movement.

Figure 4:
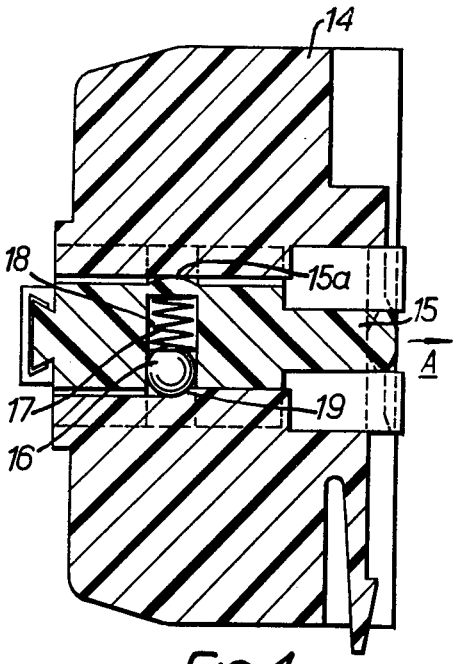
FIG. 4 is a section through the add-on block along the line IV—IV of FIG. 1.
Figure 5:
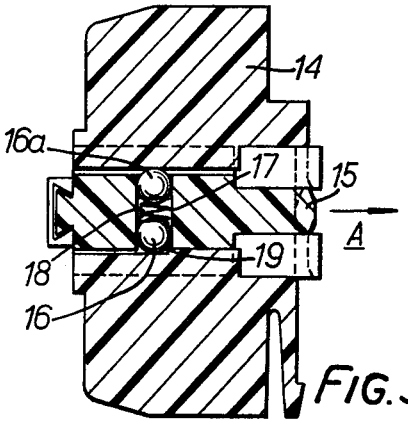
FIG. 5 is a section, similar to that of FIG. 4, through a modified embodiment of add-on block.

Referring now to FIG. 5 of the drawings, there is shown a modified add-on block wherein the transverse bore 18 extends fully through the actuating member 15 and a second ball bearing 16*a* is urged outwardly from the opposite end of the bore by the same helical spring 17 that acts upon the first ball bearing 16. The second ball bearing runs over a smooth surface of the housing 14, replacing the enlargement 15*a* which is shown in FIG. 4.

I claim:

1. An add-on contact unit for an electromagnetic switching device operable between a deenergized, spring biased first postion and an energized second position, said add-on contact unit comprising, in combination:

actuating means positively coupled to the actuator of said switching device;

a plurality of contact sets operated by said actuating means, at least one contact set being normally closed when said switching device is in said first position;

contact pressure springs for each contact set operating between said contact set and said actuating means, said contact pressure spring of said normally closed contact set and said spring biasing said switching device to said first position providing parallel, oppositely disposed spring forces; and means retaining said actuator means and said switching device in said first position against the bias of said contact pressure spring for said normally closed contact set and against the operating force of said switching device upon energization until the latter force exceeds a threshold value.

2. An electrical contact unit as claimed in claim 1, in which the actuating means comprises a linearly-movable member and in which the retaining means comprises a transverse channel in said linearly-movable member, a ball bearing urged outwardly from said channel and a body member including a shoulder behind which the ball bearing engages when the contact set is closed.

3. An electrical contact unit as claimed in claim 2, in which the retaining means includes a helical spring located in said channel to urge said ball bearing outwardly thereof.

4. An electrical contact unit as claimed in claim 1, in which the actuating means comprises a linearly movable member and in which the retaining means comprises a transverse channel formed through said linearly-movable member, a pair of ball bearings located at opposite ends of said channel, a helical spring located in said channel between said ball bearings to urge the ball bearings outwardly from opposite ends of said channel and a body member against which the ball bearings are urged and including a shoulder behind which one of the ball bearings engages when the contact set is closed.

5. An add-on contact unit for an electromagnetic switching device, said switching device having an electromagnet energizable to attract an armature thereto against the bias of an armature return spring, a plurality of contact sets operable to circuit making or circuit breaking conditions and an actuating member affixed to said armature for operating said contact sets;

said contact unit comprising, in combination:

actuating means coupled to said actuating member for positive movement therewith, said actuating means being biased to a first position by said armature return spring and being operable to a second position by energization of said electromagnet;

a plurality of contact sets operated by said actuating means and having contact pressure springs disposed between the movable contacts thereof and said actuating means;

at least one of said contact sets being normally closed when said actuating means is in said first position, said contact pressure spring of said normally closed contact set providing a force on said actuating means which is parallel and oppositely directed to the operating force provided by said armature return spring; and means for retaining said actuating means in said first position against the opposing force of said contact pressure spring and against the subsequent operating force of said electromagnetuntil the latter exceeds a threshold value.

6. An add-on contact unit for an electromagnetic switching device, said switching device having an electromagnet energizable to attract an armature thereto against the bias of an armature return spring, a plurality of contact sets operable to circuit making or circuit breaking conditions, and an actuating member affixed to said armature for operating said contact sets;

said contact unit comprising, in combination:

a housing attached to said switching device;

actuating means linearly movable in said housing and coupled to said actuating member for positive movement therewith;

a plurality of contact sets each having stationary contacts mounted in said housing and a respective movable contact carried by said actuator means, at least one of said contact sets being normally closed wherein the respective movable contact is in circuit making engagement with the cooperating stationary contacts thereof when said electromagnet is deenergized, said armature, actuating member and actuating means being extended under the bias of said return springs;

contact pressure springs for said contact sets, said springs being operable between said actuator means and said movable contacts to bias said movable contacts into engagement with said stationary contacts, said spring for said normally closed contact set providing a parallel and oppositely disposed force to that of said return spring; and means retaining said actuator means in the extended position thereof against the bias of said contact pressure spring of said normally closed contact and against an actuating force applied by said electromagnet until the latter force exceeds a threshold value.

* * * * *